US005197773A

United States Patent [19]

Vick, Jr.

[11] Patent Number: 5,197,773

[45] Date of Patent: Mar. 30, 1993

[54] RUNNING AND PULLING TOOL

[75] Inventor: James D. Vick, Jr., Red Oak, Tex.

[73] Assignee: Otis Engineering Corporation, Dallas, Tex.

[21] Appl. No.: 775,578

[22] Filed: Oct. 15, 1991

[51] Int. Cl.[5] ..... E21B 23/00

[52] U.S. Cl. ..... 294/86.18; 294/86.25

[58] Field of Search ..... 294/86.17, 86.18, 86.19, 294/86.24, 86.25; 166/125, 137, 217

[56] References Cited

U.S. PATENT DOCUMENTS

| | | | |
|---|---|---|---|
| 4,295,528 | 10/1981 | Carmady | 166/217 X |
| 4,538,681 | 9/1985 | Johnston | 166/125 |
| 4,558,895 | 12/1985 | Tamplen | 294/86.18 |
| 4,767,145 | 8/1988 | Bullard | 294/86.18 |
| 4,838,594 | 6/1989 | Bullard | 294/86.18 |
| 4,848,820 | 7/1989 | Morrell | 294/86.18 |
| 5,066,060 | 11/1991 | Cooksey et al. | 294/86.18 |

FOREIGN PATENT DOCUMENTS

| | | | |
|---|---|---|---|
| 1512350 | 2/1968 | France | 294/86.24 |

*Primary Examiner*—Russell D. Stormer
*Assistant Examiner*—Dean J. Kramer
*Attorney, Agent, or Firm*—Roland O. Cox

[57] ABSTRACT

An improved running or pulling tool which automatically connects to a lock mandrel when the improved tool dogs are inserted into a lock mandrel fishing neck. The dogs are releasably positioned for automatic connection by lower shear members. The tool is releasably positioned in a configuration for downward jarring by upper shear members. When operating to lock a lock mandrel in or unlock a lock mandrel for retrieval from a well conduit, the improved tool may be jarred repeatedly upwardly or downwardly as required. The improved tool may be disconnected and released from the lock mandrel at any time during locking or unlocking operations by jarring upwardly to shear the upper members followed by downward jarring to shear the lower members. The tool may be operated to release by downward jarring if the tool skirt or core contacts a lock mandrel fishing neck.

6 Claims, 2 Drawing Sheets

RUNNING AND PULLING TOOL

BACKGROUND OF THE INVENTION

1. Technical Field

This invention pertains to tools useful in servicing earth wells and in particular pertains to running and pulling tools releasably connectible to lock mandrels for locking the lock mandrel in or unlocking the lock mandrel for retrieval from a well flow conduit.

2. Description of the Related Art

Combination running and pulling tools have been developed which, after connection to the fishing neck on a flow control device lock mandrel and lowered into a well conduit, may be jarred downwardly or upwardly as required to install the lock mandrel and flow control device in a well conduit. These tools also may be jarred downwardly or upwardly as required after connection to a fishing neck to unlock the lock mandrel and flow control device from the well conduit for retrieval. If the running pulling tool cannot install or release the device lock mandrel from the well conduit by downward or upward jarring, the tool may again be jarred downwardly and released from the lock mandrel for retrieval from the conduit. On jarring downwardly to release, these running pulling tools will operate to release if either the tool skirt or tool core contacts the fishing neck on the lock mandrel. Examples of such running pulling tools are shown in U.S. Pat. Nos. 4,767,145 and 4,838,594 to Bullard. Both patents are incorporated herein for reference.

SUMMARY OF THE INVENTION

The improved running pulling tool of this invention provides a tool which is releasably connectible into the fishing neck of a lock mandrel on a well flow control device on surface. The running pulling tool with connected flow control device is lowered into a well flow conduit and the running pulling tool may be operated to install the flow control device lock mandrel in the flow conduit and released from the flow control device lock mandrel for retrieval to surface by being jarred downwardly or upwardly by jars in a well servicing tool string. The invention running pulling tool is also releasably connectible to the fishing neck on a well flow control device installed in a well flow conduit for "pulling" or operating the installed lock mandrel to release from the well conduit for retrieval to surface. After connection to a fishing neck, the invention running pulling tool may be jarred repeatedly downward and repeatedly upward as required. Upward jarring shears members and moves lugs locking a lug expander to the running pulling tool body to an unlocked position. If the lock mandrel cannot be operated to release for retrieval by downward and upward jarring, the running pulling tool may again be jarred downwardly. Downward jarring shears lower members and permits movement of lugs locking the running pulling tool sleeve to the body to an unlocked position. Compressed springs in the improved running pulling tool may now extend and move the sleeve, skirt and dogs upwardly to a retracted position on the tool, releasing the running pulling tool from the lock mandrel fishing neck for retrieval to surface. On surface, the improved running pulling tool may easily be prepared for further use by realigning shear member holes and replacing sheared members.

A principal object of this invention is to provide one tool which may be used to lock a lock mandrel in or unlock a lock mandrel from a well conduit.

Also an object of this invention is to provide a running pulling tool which automatically connects to a lock mandrel on insertion into a lock mandrel fishing neck.

Another object of this invention is to provide one running pulling tool which, after connection to a lock mandrel fishing neck, may be either jarred downwardly repeatedly as required or may be jarred upwardly repeatedly as required.

Another invention object is to provide a running pulling tool which may be disconnected from a lock mandrel fishing neck at any time after connection thereto.

Another object of this invention is to provide a running pulling tool which when jarred downwardly will operate to disconnect from a lock mandrel fishing neck if either the running pulling tool skirt or core contacts the fishing neck.

Also an object of this invention is to provide a running pulling tool having greater resistance to jarring impact.

BEST MODE FOR CARRYING OUT THE INVENTION

Figure 1:
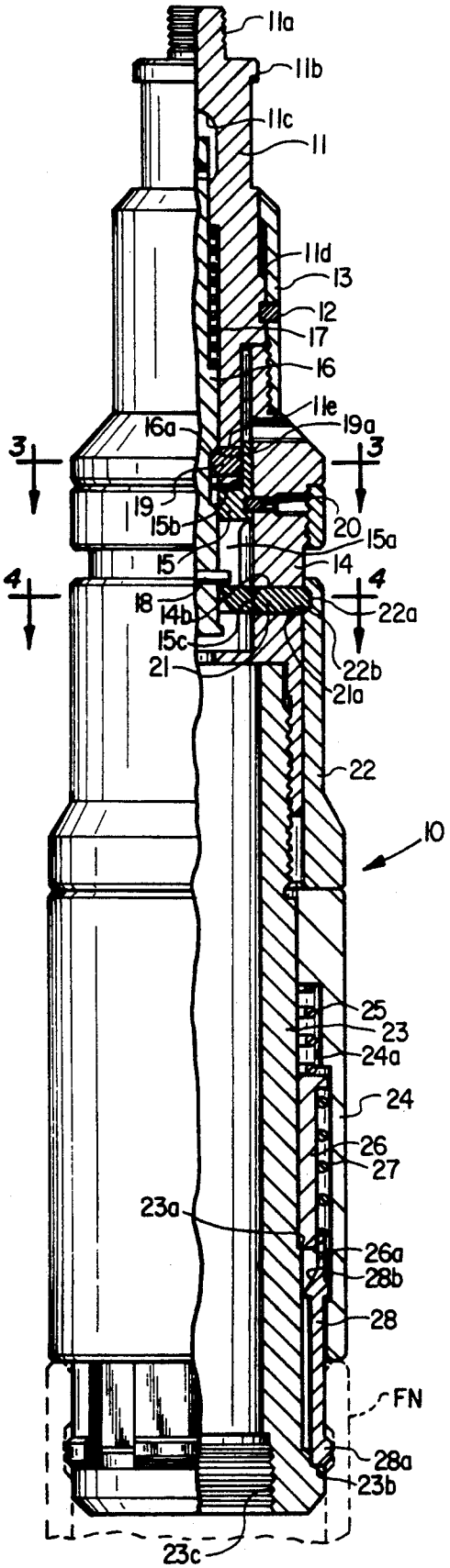
FIG. 1 is a sectioned drawing in elevation showing the improved running pulling tool of this invention connected to a lock mandrel fishing neck with the running pulling tool skirt contacting the fishing neck.

FIG. 1 depicts the invention running pulling tool 10 having an upper body 11, which has a threaded connector **11*a*, a fishing neck with flange 11*b*, a through slot 11*c* and a shoulder 11*d*. Releasably positioned around the upper body by upper shear members 12 is a body extension 13 connected to lower body 14**.

Slidably mounted in bores in the upper body and a spool 15 is a rod 16 having a camming surface **16*a*. Around the rod is a compressed bias 17 and a cross pin 18 is positioned by friction in a lateral hole in the rod and extends into a slot 15*a* in the spool. Pin 18 in slot 15*a*** limits the up down travel of the rod in the spool.

Slidably mounted in lateral openings **11*e* in the upper body are upper lugs 19, each having a camming surface 19*a***.

Figure 3:
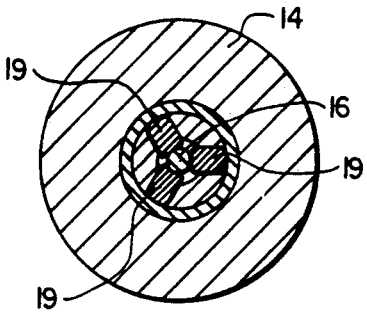
FIG. 3 is a cross sectional drawing along line 3—3 of FIG. 1.

The spool has a bore **15*b* and is releasably positioned by lower shearable members 20 in lower body 14 so that bore 15*b* holds upper lugs 19 in retracted position and lug camming surfaces 19*a* in contact with rod camming surfaces 16*a***, locking the upper body to the rod (See also FIG. 3).

Figure 4:
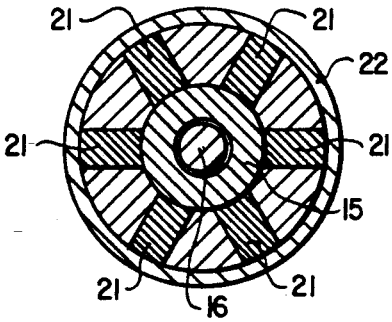
FIG. 4 is a cross sectional drawing along line 4—4 of FIG. 1.

Slidably mounted in lateral openings 14b in the lower body are expanded lower lugs 21, each having a camming surface 21a which is contacting a camming surface 22b in groove 22a in sleeve 22 which is slidably mounted around the lower body. Expanding diameter 15c on spool 15 holds the lower lugs expanded into sleeve groove 22a, locking the sleeve to the lower body as shown in FIGS. 1 and 4.

A core 23 is connected into the lower body. Slidably mounted around the core is a skirt 24 which has a bore 24a. A compressed bias 25 around the core in bore 24a biases the skirt upwardly to contact the lower end of sleeve 22 and biases a spacer 26 downwardly so its lower end contacts a shoulder 23a on the core. A lower weaker compressed bias 27 around the spacer between a shoulder on the spacer and the upper end of a number of dogs 28, biases the dogs downwardly such that their lower end contacts a lower shoulder 23b on the core. Each dog has a lug portion 28a which is contoured to fit into a fishing neck groove and a camming surface 28b which is engageable with camming surface 26a on the spacer. The lower end of the core is provided with a connector 23c for connection of any operating prongs required for locking or unlocking a lock mandrel.

Figure 5:
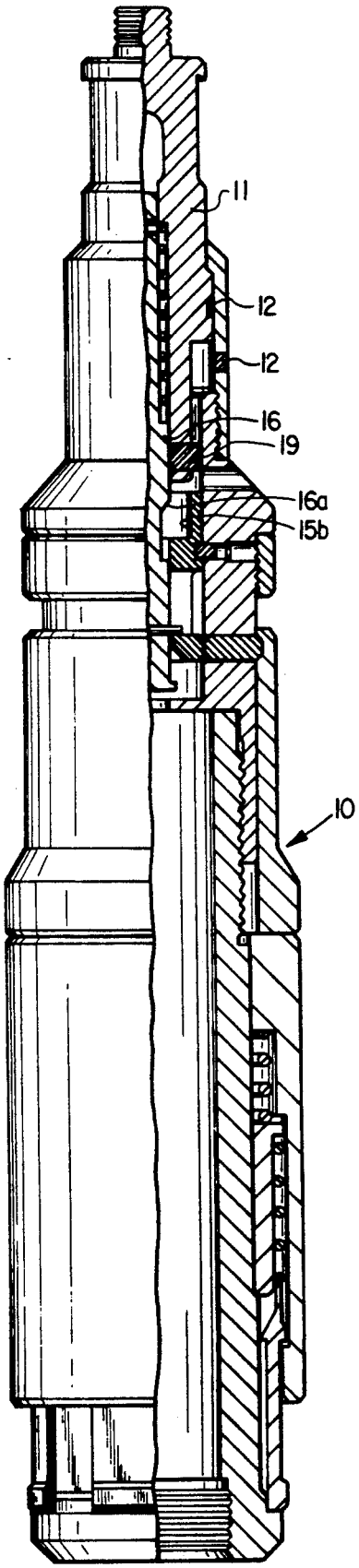
FIG. 5 is a sectioned drawing in elevation showing the invention running pulling tool in pre-release position.

The running pulling tool 10 is useful as a running tool on attachment on surface to a well servicing tool string (not shown) usually including mechanical or hydraulic jars. The running tool automatically connects to a lock mandrel (not shown) by inserting the running pulling tool core 23 and dogs 28 into the lock mandrel fishing necks FN of FIG. 1 with the running pulling tool skirt contacting the fishing neck or FIG. 2 with the running pulling tool core contacting the fishing neck. The well servicing tool string, running pulling tool, lock mandrel and any attached flow device are lowered into a well conduit until downward motion of the lock mandrel is stopped. The running pulling tool may be jarred downwardly and upwardly repeatedly as required to operate the lock mandrel to seal and lock in the well conduit, positioning the well flow device for operation. After the lock mandrel is locked with running pulling tool 10 connected, operating the well servicing tool string to jar upwardly shears upper members 12 and moves upper body 11 upwardly around rod 16. Upper lugs 19 are moved upwardly out of spool bore 15b, over rod camming surface 16a and cammed outwardly into pre-release position as shown in FIG. 5.

Downward jarring on running pulling tool 10 in the pre-release position will transmit impact forces through upper body 11 into expanded lugs 19 and onto spool 15 to shear lower members 20 and move the spool and expanding diameter 15c down from inside lower lugs 21 unlocking sleeve 22 from lower body 14. Now, compressed bias 25 extends moving skirt 24 and the sleeve camming surface 22b upward over lower lug camming surface 21a, camming the lugs inwardly from sleeve groove 22a. At the same time, upward movement of the skirt has picked up dogs 28, compressed weaker bias 27, engaged camming surface 28b with spacer camming surface 26a and retracted the dogs, releasing tool 10 from the lock mandrel fishing neck for retrieval back to surface (see FIG. 6).

Figure 2:
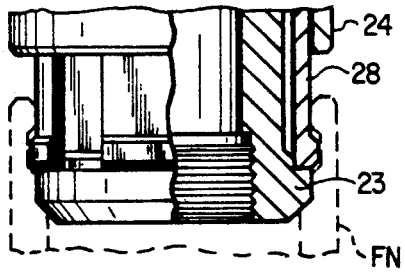
FIG. 2 is a fragment of the drawing of FIG. 1 showing the invention running pulling tool connected to a lock mandrel fishing neck with the running pulling tool core contacting the fishing neck.
Figure 6:
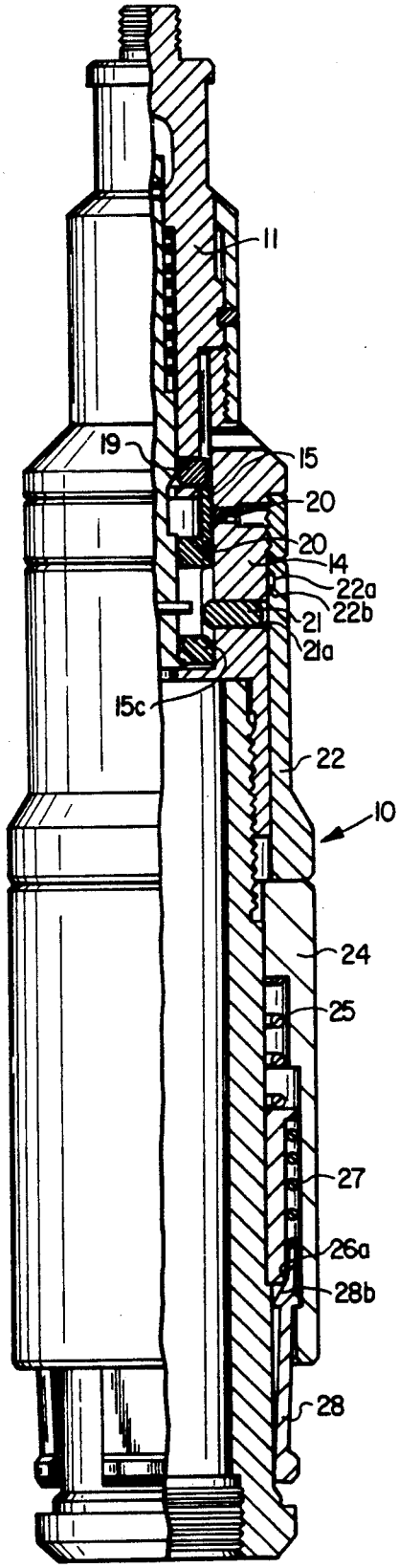
FIG. 6 is also a sectioned drawing in elevation showing the invention tool released from a lock mandrel fishing neck.

The running pulling tool of this invention is also useful to pull (unlock and retrieve back to surface) a lock mandrel locked in a well flow conduit. Tool 10 as shown in FIG. 1 is connected to a well servicing tool string including a jarring device and lowered into a well flow conduit until the lug portions 28a of dogs 28 contact the lock mandrel fishing neck. Application of weight or a jar down stroke will now move the dogs upwardly on core 23 compressing bias 27 until dog camming surface 28b contacts and moves over spacer camming surface 26a. The dogs are now retracted to the position shown in FIG. 6 and tool 10 drops down into the fishing neck with the skirt contacting the top of the fishing neck (FIG. 1) or the core contacting the fishing neck (FIG. 2). Automatic extension of compressed bias 27 now moves the dogs with lug portions 28a downwardly and outwardly into the fishing neck groove connecting tool 10 to the fishing neck. Jars in the well servicing tool string may now be operated repeatedly as required to jar downwardly and jar upwardly to unlock the lock mandrel for retrieval. Upward jarring places tool 10 in the pre-release position as shown in FIG. 5. If the lock mandrel cannot be unlocked by repeatedly jarring downwardly and upwardly or upwardly only, tool 10 may be jarred downwardly from the pre-release position to release position as previously explained for the running operation and as shown in FIG. 6.

At any time during running or pulling operations, invention tool 10 may be released from a lock mandrel fishing neck by jarring upwardly to shear members 12 and place tool 10 in pre-release position followed by jarring downwardly to shear members 20 to release for retrieval to surface. On surface, tool 10 parts may be repositioned as shown in FIG. 1 and sheared members 12 and 20 replaced to prepare the invention running pulling tool for further use as a running or pulling tool.

What I claim is:

1. An improved running pulling tool connectable to a fishing neck comprising:

(a) a lower body having an upper body slidably mounted therein, said upper body connectable to well servicing tools;

(b) a spool slidably mounted in said lower body;

(c) means for releasably positioning said upper body and spool in said lower body;

(d) a rod slidably mounted in said upper body and spool;

(é) means for releasably connecting said rod in said upper body;

(f) a core connected to and extending from said lower body;

(g) means slidably mounted around said lower body and said core for automatically connecting to and releasing from a fishing neck; and (h) means releasably positioning said connecting and releasing means in automatic connecting position on said lower body and core, said connecting and releasing means moveable on release of said positioning means to a position releasing said connecting and releasing means from said fishing neck.

2. A running pulling tool according to claim 1 wherein the means for positioning the upper body and spool in the lower body are shear members through the lower body into said upper body and spool.

3. A running pulling tool according to claim 1 wherein the means for releasably connecting the rod in the upper body comprises:

(a) a camming surface on the rod;

(b) lateral openings in the upper body; and (c) a lug slidably mounted in each said opening, each said lug having a camming surface engageable with said rod camming surface.

4. A running pulling tool according to claim 1 wherein the means for automatically connecting to and releasing from a fishing neck comprises:

(a) upper and lower shoulders on the core;

(b) a skirt having an internal shoulder slidably mounted around said core;

(c) a spacer having a camming surface and an external shoulder, said spacer slidably mounted around said core above said upper core shoulder;

(d) an upper compressed bias around said core between the upper end of said spacer and said skirt internal shoulder;

(e) a number of dogs each having an external shoulder, a camming surface and a lug portion connectible in a fishing neck, said dogs slidably mounted in said skirt and around said core;

(f) a lower weaker compressed bias between said spacer external shoulder and the upper end of said dogs biasing said dogs to contact said lower core shoulder, said dogs longitudinally moveable to slide said dog camming surfaces over said spacer camming surface, camming said dog lugs in to a retracted position released from said fishing neck.

5. A running pulling tool according to claim 4 wherein the means releasably positioning the connecting and releasing means in automatic connecting position comprises:

(a) lateral openings in the lower body;

(b) a lug having a camming surface slidably mounted in each said opening;

(c) a sleeve slidably mounted around said lower body and core, said sleeve having a groove with a camming surface, the lower end of said sleeve contacting the upper end of the skirt; and (d) an expanding diameter on the spool for expanding said lugs into said sleeve groove so that said lug camming surfaces engage said sleeve groove camming surfaces, said spool expanding diameter longitudinally moveable to a position not expanding said lugs into said sleeve groove and permitting said sleeve camming surface to be moved upwardly over said lug camming surfaces, camming said lugs to a retracted position and said skirt to move upwardly to a position camming said dogs to retracted position.

6. An improved running tool automatically connectable to and releasable from a fishing neck comprising:

(a) a lower body having an upper body slidably mounted therein, said upper body connectable to well servicing tools;

(b) a spool slidably mounted in said lower body;

(c) means for releasably positioning said upper body and spool in said lower body including, upper shear members through said lower body into said upper body and lower shear members through said lower body into said spool;

(d) a rod slidably mounted in said upper body;

(e) means for releasably connecting said rod in said upper body including, a camming surface on the rod, lateral openings in the upper body, a lug slidably mounted in each said opening, each said lug having a camming surface engageable with said rod camming surface;

(f) a core connected to and extending from said lower body;

(g) means slidably mounted around said lower body and said core for automatically connecting to and releasing from a fishing neck including, upper and lower shoulders on said core, a skirt having an internal shoulder slidably mounted around said core, a spacer having a camming surface and an external shoulder, said spacer slidably mounted around said core above said upper core shoulder, an upper compressed bias around said core between the upper end of said spacer and said skirt internal shoulder, a number of dogs each having an external shoulder, a camming surface and a lug portion connectable in a fishing neck, said dogs slidably mounted in said skirt and around said core, a lower weaker compressed bias between said spacer external shoulder and the upper end of said dogs biasing said dogs to contact said lower core shoulder, said dogs longitudinally moveable to slide said dog camming surface over said spacer camming surface camming said dog lugs in to a retracted position released from said fishing neck, and (h) means releasably positioning said connecting and releasing means in automatic connecting position on said lower body and core, said connecting and releasing means moveable on release of said positioning means to a position releasing said connecting and releasing means from said fishing neck, said releasably positioning means including, lateral openings in said lower body, a lug having a camming surface slidably mounted in each said opening, a sleeve slidably mounted around said lower body and core, said sleeve having a groove with a camming surface, the lower end of said sleeve contacting the upper end of said skirt, and an expanding diameter on said spool for expanding said lugs into said sleeve groove so that said lug camming surfaces engage said sleeve groove camming surfaces, said spool expanding diameter longitudinally moveable to a position not expanding said lugs into said sleeve groove and permitting said sleeve camming surface to be moved upwardly over said lug camming surfaces, camming said lugs to a retracted position and said skirt to move upwardly to a position camming said dogs to retracted position.

* * * * *